US009047812B2

(12) United States Patent
Chun et al.

(10) Patent No.: US 9,047,812 B2
(45) Date of Patent: Jun. 2, 2015

(54) DISPLAY DEVICE, APPARATUS FOR COMPENSATING DEGRADATION AND METHOD THEREOF

(71) Applicant: Samsung Display Co., Ltd., Yongin, Gyeonggi-Do (KR)

(72) Inventors: Byung-Ki Chun, Yongin (KR); Hak-Sun Kim, Yongin (KR); Yong-Seok Choi, Yongin (KR); Joo-Hyung Lee, Yongin (KR); Jong-Woong Park, Yongin (KR); Bo-Young An, Yongin (KR); Chang-Ho Hyun, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 165 days.

(21) Appl. No.: 13/780,175

(22) Filed: Feb. 28, 2013

(65) Prior Publication Data

US 2014/0118426 A1 May 1, 2014

(30) Foreign Application Priority Data

Oct. 31, 2012 (KR) ..... 10-2012-0122624

(51) Int. Cl.
*G09G 3/32* (2006.01)

(52) U.S. Cl.
CPC ..... *G09G 3/3208* (2013.01)

(58) Field of Classification Search
CPC ..... G09G 3/30–3/3208; G09G 2320/0233; G09G 2320/029; G09G 2320/0295; G09G 2320/04–2320/048; G09G 2330/12
USPC ..... 345/76–83
See application file for complete search history.

(56) References Cited

U.S. PATENT DOCUMENTS

| | | | | |
|---|---|---|---|---|
| 7,411,344 | B2 | 8/2008 | Yamazaki et al. | |
| 7,880,380 | B2 | 2/2011 | Yamazaki et al. | |
| 8,279,143 | B2 | 10/2012 | Nathan et al. | |
| 8,284,218 | B2 | 10/2012 | Yoshida | |
| 2004/0150594 | A1* | 8/2004 | Koyama et al. | 345/82 |
| 2004/0256620 | A1 | 12/2004 | Yamazaki et al. | |
| 2008/0231558 | A1* | 9/2008 | Naugler | 345/76 |
| 2010/0123649 | A1 | 5/2010 | Hamer et al. | |
| 2011/0069051 | A1* | 3/2011 | Nakamura et al. | 345/207 |
| 2011/0130981 | A1* | 6/2011 | Chaji et al. | 702/58 |

FOREIGN PATENT DOCUMENTS

| | | | |
|---|---|---|---|
| JP | 2003-177714 | A | 6/2003 |
| JP | 2003-280583 | A | 10/2003 |
| KR | 10-2009-0058788 | A | 6/2009 |
| KR | 10-2011-0086596 | A | 7/2011 |

* cited by examiner

*Primary Examiner* — Liliana Cerullo
(74) *Attorney, Agent, or Firm* — Robert E. Bushnell, Esq.

(57) ABSTRACT

A display device includes: a plurality of pixels; a degradation compensator for using a temperature weight value for a reference temperature, a luminance weight value for a reference luminance, and a material weight value for a reference material, for calculating a reference using time when a degradation rate of the pixels is changed to a reference degradation rate of a reference degradation curve, and for generating a control variable according to the reference using time; and a power supply for controlling a voltage difference between a first power source voltage for supplying a driving current to the pixels and a second power source voltage according to the control variable.

32 Claims, 7 Drawing Sheets

DISPLAY DEVICE, APPARATUS FOR COMPENSATING DEGRADATION AND METHOD THEREOF

CLAIM OF PRIORITY

This application makes reference to, incorporates into this specification the entire contents of, and claims all benefits accruing under 35 U.S.C. §119 from an application earlier filed in the Korean Intellectual Property Office filed on Oct. 31, 2012, and there duly assigned Ser. No. 10-2012-0122624.

BACKGROUND OF THE INVENTION

1. Field of the Invention

The present invention relates to a display device, a degradation compensating device, and a degradation compensating method. More particularly, the present invention relates to a display device for compensating for degradation of light emitting elements, a degradation compensating device, and a degradation compensating method.

2. Description of the Related Art

The organic light emitting diode (OLED) display uses an organic light emitting diode (OLED) for controlling luminance by current or voltage and a thin film transistor for driving it. The organic light emitting diode (OLED) includes an anode layer and a cathode layer for forming an electric field, and an organic light emitting material electric field for emitting light by the electric field. The thin film transistor is classified as an amorphous silicon thin film transistor (amorphous-Si TFT), a low temperature polysilicon (LTPS) thin film transistor, and an oxide thin film transistor (TFT) according to types of activation layers.

A pixel is degraded by degradation of the organic light emitting diode (OLED) and the thin film transistor, and degradation of the pixel causes luminance deterioration of the pixel. When a predetermined voltage is applied to a pixel, current flowing to the pixel is reduced because of degradation of an organic light emitting diode (OLED) and a thin film transistor, and the pixel's luminance is deteriorated.

A power source voltage for providing a driving current of a pixel can be set to have a large value when a product is delivered in consideration of degradation of the pixel, and in this case, an unneeded voltage is also supplied to increase power consumption of a display device before the organic light emitting diode (OLED) and the thin film transistor are degraded.

The above information disclosed in this Background section is only for enhancement of an understanding of the background of the invention and therefore it may contain information that does not form the prior art that is already known in this country to a person of ordinary skill in the art.

SUMMARY OF THE INVENTION

The present invention has been developed in an effort to provide a display device for reducing power consumption of a display device and compensating for degradation of a pixel, a degradation compensating device, and a degradation compensating method.

An exemplary embodiment of the present invention provides a display device including: a plurality of pixels; a degradation compensator for using a temperature weight value for a reference temperature, a luminance weight value for a reference luminance, and a material weight value for a reference material, for calculating a reference using time when a degradation rate of the pixels is exchanged to a reference degradation rate of a reference degradation curve, and for generating a control variable according to the reference using time; and a power supply for controlling a voltage difference between a first power source voltage for supplying a driving current to the pixels and a second power source voltage according to the control variable.

The temperature weight value represents a ratio of a degradation rate caused by a measured temperature of the pixels versus a degradation rate at the reference temperature.

The degradation compensator stores the temperature weight value corresponding to the measured temperature of the pixels into a look up table (LUT).

The degradation compensator calculates an average grayscale of an image data signal including grayscale information on the pixels, and calculates luminance of an image corresponding to the average grayscale of the image data signal.

The luminance weight value is a ratio of a degradation rate caused by luminance of the image versus the degradation rate for the reference luminance.

The degradation compensator stores the luminance weight value corresponding to the average grayscale of the image data signal into a lookup table (LUT).

The degradation compensator stores the luminance weight value corresponding to luminance of the image into a lookup table (LUT).

The material weight value is a ratio of a degradation rate caused by a material included in the pixels versus a degradation rate of a pixel including the reference material.

The degradation compensator calculates the reference using time by using a sum of an accumulated using time and a value that is generated by multiplying an additional using time that is added after the accumulated using time of the pixels by the temperature weight value, the luminance weight value, and the material weight value.

The degradation compensator updates the calculated reference using time as an accumulated using time of the pixels and stores the same.

The degradation compensator calculates the reference using time by using a sum of the accumulated using time and a value that is generated by multiplying the additional using time that is added after the accumulated using time of the pixels by the temperature weight value, the luminance weight value, the material weight value, and the time weight value according to the accumulated using time.

When the control variable is increased, the power supply reduces the second power source voltage to increase the voltage difference between the first power source voltage and the second power source voltage.

When the control variable is increased, the power supply increases the first power source voltage to increase the voltage difference between the first power source voltage and the second power source voltage.

Another embodiment of the present invention provides a degradation compensating device including: a temperature weight value generator for generating a temperature weight value for indicating a degradation rate caused by a measured temperature of a plurality of pixels transmitted by a temperature sensor as a ratio on the degradation rate with respect to a reference temperature; a grayscale calculator for calculating an average grayscale of an image data signal including grayscale information on the pixels; a luminance weight value generator for calculating luminance of an image corresponding to an average grayscale of the image data signal, and for generating a luminance weight value for indicating a degradation rate caused by luminance of the image as a ratio on the degradation rate at reference luminance; a using time calculator for storing a material weight value for indicating a degradation rate caused by a material included in the pixels as a ratio of a degradation rate of the pixel including a reference material, and for using the temperature weight value, the luminance weight value, and the material weight value to calculate a reference using time when an actual degradation rate of the pixels is changed into a degradation rate on a reference degradation curve; and a control variable generator for generating a control variable according to the reference using time.

The temperature weight value generator stores the temperature weight value corresponding to a measured temperature of the pixels into a lookup table (LUT).

The luminance weight value generator stores the luminance weight value corresponding to an average grayscale of the image data signal into a lookup table (LUT).

The luminance weight value generator stores the luminance weight value corresponding to luminance of the image into a lookup table (LUT).

The using time calculator calculates the reference using time by using a sum of an accumulated using time and a value that is generated by multiplying an additional using time that is added after the accumulated using time of the pixels by the temperature weight value, the luminance weight value, and the material weight value.

The degradation compensating device further includes a using time storage unit for updating the calculated reference using time as an accumulated using time of the pixels, and for storing the same.

The using time calculator calculates the reference using time by using a sum of an accumulated using time and a value that is generated by multiplying an additional using time that is added after the accumulated using time of the pixels by the temperature weight value, the luminance weight value, the material weight value, and the time weight value following the accumulated using time.

The degradation compensating device further includes a power supply for controlling a voltage difference between a first power source voltage for supplying a driving current to the pixels according to the control variable and a second power source voltage.

When the control variable is increased, the power supply reduces the second power source voltage to increase a voltage difference between the first power source voltage and the second power source voltage.

When the control variable is increased, the power supply increases the first power source voltage to increase a voltage difference between the first power source voltage and the second power source voltage.

Yet another embodiment of the present invention provides a degradation compensating method, including: generating a temperature weight value for indicating a degradation rate caused by a measured temperature of a plurality of pixels transmitted by a temperature sensor with a ratio on a degradation rate at a reference temperature; calculating an average grayscale of an image data signal including grayscale information on the pixels; calculating luminance of an image corresponding to the average grayscale of the image data signal, and generating a luminance weight value for indicating the degradation rate caused by the luminance of image as a ratio on a degradation rate at reference luminance; outputting a material weight value for indicating a degradation rate caused by a material included in the pixels as a ratio on the degradation rate of the pixel including a reference material; calculating a reference using time when an actual degradation rate of the pixels is exchanged into a degradation rate on a reference degradation curve by using the temperature weight value, the luminance weight value, and the material weight value; and generating a control variable according to the reference using time.

The degradation compensating method further includes controlling a voltage difference between a first power source voltage for supplying a driving current to the pixels and a second power source voltage according to the control variable.

The controlling of a voltage difference between a first power source voltage and a second power source voltage includes, when the control variable is increased, reducing the second power source voltage to increase the voltage difference between the first power source voltage and the second power source voltage.

The controlling of a voltage difference between a first power source voltage and a second power source voltage includes, when the control variable is increased, increasing the first power source voltage to increasing the voltage difference between the first power source voltage and the second power source voltage.

The generating of a temperature weight value includes outputting the temperature weight value corresponding to a measured temperature of the pixels from the lookup table (LUT).

The generating of a luminance weight value includes outputting the luminance weight value corresponding to an average grayscale of the image data signal from the lookup table (LUT).

The generating of a luminance weight value includes outputting the luminance weight value corresponding to luminance of the image from the lookup table (LUT).

The calculating of a reference using time includes calculating the reference using time by using a sum of an accumulated using time and a value that is generated by multiplying an additional using time that is added after the accumulated using time of the pixels by the temperature weight value, the luminance weight value, and the material weight value.

The degradation compensating method further includes updating the calculated reference using time as an accumulated using time of the pixels and storing the same.

According to the embodiments of the present invention, degradation of pixels is compensated while power consumption of the display device is reduced, and image quality of the display device is improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE EMBODIMENTS

Figure 1:
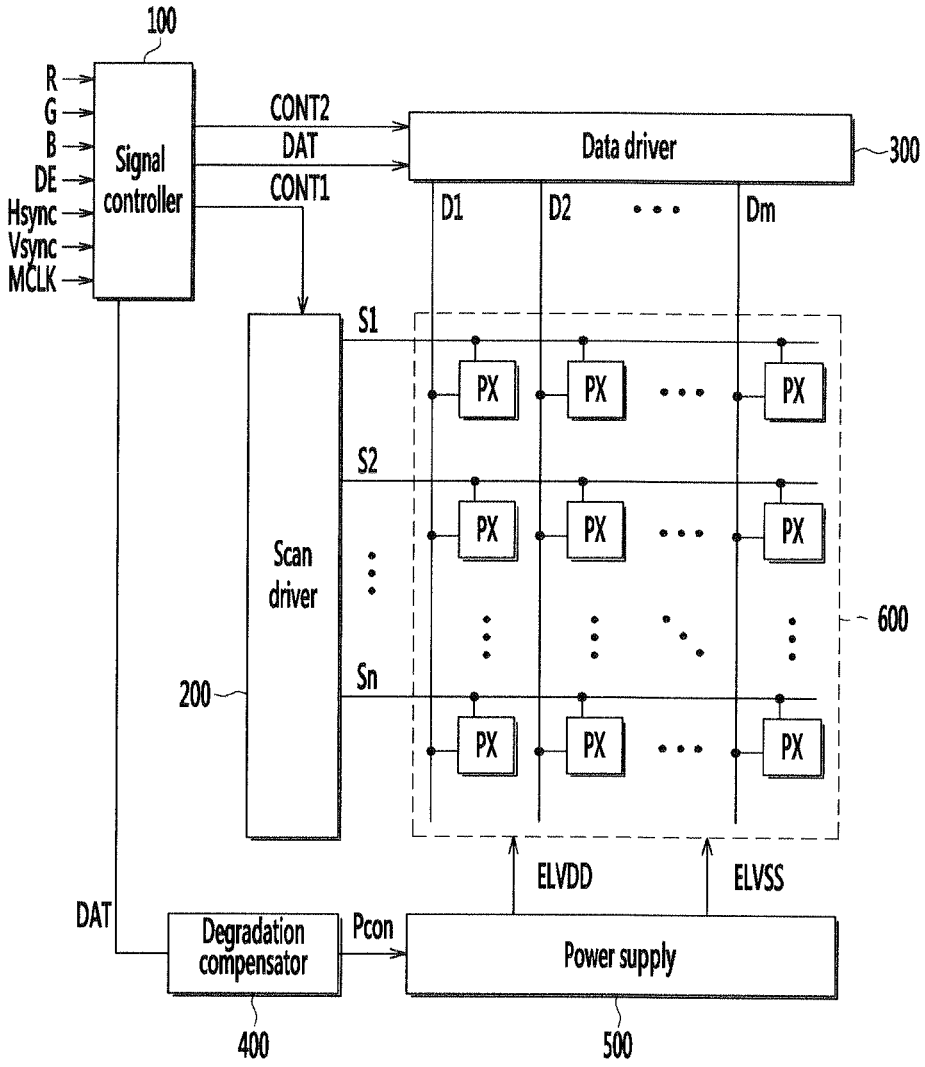
FIG. 1 shows a block diagram of a display device according to an exemplary embodiment of the present invention.

Hereinafter, exemplary embodiments according to the present invention will be described in detail with reference to accompanying drawings so as to be easily understood by a person of ordinary skill in the art. However, the present invention can be variously implemented and is not limited to the following embodiments.

Further, in exemplary embodiments, since like reference numerals designate like elements having the same configuration, a first exemplary embodiment is representatively described, and in other exemplary embodiments, only a configuration different from the first exemplary embodiment will be described.

A part irrelevant to the description will be omitted so as to clearly describe the present invention, and the same elements will be designated by the same reference numerals throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment of the present invention.

Referring to FIG. 1, the display device includes a signal controller 100, a scan driver 200, a data driver 300, a degradation compensator 400, a power supply 500, and a display 600. The display device can be a liquid crystal display (LCD), a field emission display, a plasma display panel (PDP), and an organic light emitting display, and types of the display device are not restricted.

The signal controller 100 receives video signals (R, G, and B) and synchronous signals from an external device. The video signals (R, G, and B) include luminance information of respective pixels (PX), and the luminance includes a predetermined number (e.g., $1024=2^{10}$, $256=2^{8}$, or $64=2^{6}$) of grayscales. Input control signals exemplarily include a vertical synchronization signal (Vsync), a horizontal synchronization signal (Hsync), a main clock signal (MCLK), and a data enable signal (DE).

The signal controller 100 generates a first drive control signal (CONT1), a second drive control signal (CONT2), and an image data signal (DAT) according to the video signals (R, G, and B), the horizontal synchronization signal (Hsync), the vertical synchronization signal (Vsync), and the main clock signal (MCLK).

The signal controller 100 generates the image data signal (DAT) by identifying the video signals (R, U, and B) for each frame according to the vertical synchronization signal (Vsync) and identifying the video signals (R, G, and B) for each scan line according to the horizontal synchronization signal (Hsync). The signal controller 100 transmits the image data signal (DAT) and the first drive control signal (CONT1) to the data driver 300. The signal controller 100 transmits the image data signal (DAT) to the degradation compensator 400.

The display 600 includes a plurality of pixels (PX) connected to a plurality of scan lines S1-Sn, a plurality of data lines D1-Dm, and a plurality of signal lines (S1-Sn and D1-Dm) and substantially arranged in a matrix form. The plurality of scan lines S1-Sn are substantially extended in a row direction and are in parallel with each other. The plurality of data lines D1-Dm are substantially extended in a column direction and are in parallel with each other. The plurality of pixels (PX) receive a first power source voltage (ELVDD) and a second power source voltage (ELVSS) from the power supply 500.

The scan driver 200 is connected to the scan lines S1-Sn, and generates a plurality of scan signals (S[1]-S[n]) according to the first drive control signal (CONT1 ). The scan driver 200 can sequentially apply scan signals (S[1]-S[n]) with a gate on voltage to the scan lines S1-Sn.

The data driver 300 is connected to a plurality of data lines D1-Dm, samples and holds the image data signal (DAT) according to the second drive control signal (CONT2), and applies a plurality of data signals to the data lines D1-Dm. The data driver 300 writes data to a plurality of pixels by applying a data signal having a predetermined voltage range to the data lines D1-Dm corresponding to the scan signals (S[1]-S[n]) with a gate on voltage.

The degradation compensator 400 generates a control variable (Pcon) according to a degradation rate of a plurality of pixels (PX) based on a using time, temperature, and luminance of a plurality of pixels (PX), and a material of the light emitting element. A degradation rate of a plurality of pixels (PX) represents a luminance reduction rate. The degradation compensator 400 uses a temperature weight value (WT) for the reference temperature, a luminance weight value (WL) for the reference luminance, and a material weight value (WM) for the reference material to calculate a reference using time (Tcur) when the actual degradation rate of a plurality of pixels (PX) is exchanged into a reference degradation rate on a reference degradation curve and generates the control variable (Pcon) according to the reference using time (Tcur). The degradation compensator 400 transmits the control variable (Pcon) to the power supply 500.

The power supply 500 supplies a first power source voltage (ELVDD) and a second power source voltage (ELVSS) to the display 600. The first power source voltage (ELVDD) and the second power source voltage (ELVSS) provide a driving current for a plurality of pixels (PX). The power supply 500 controls the voltage difference between the first power source voltage (ELVDD) and the second power source voltage (ELVSS) according to the control variable (Pcon). The power supply 500 controls a voltage difference between the first power source voltage (ELVDD) and the second power source voltage (ELVSS) by increasing the second power source voltage (ELVSS) or reducing the first power source voltage (ELVDD) by a predetermined voltage level established by the control variable (Pcon).

The degradation compensator 400 for generating a control variable (Pcon) according to a degradation rate of a light emitting element, and a degradation compensating method, will now be described with reference to FIGS. 2 to 7.

Figure 2:
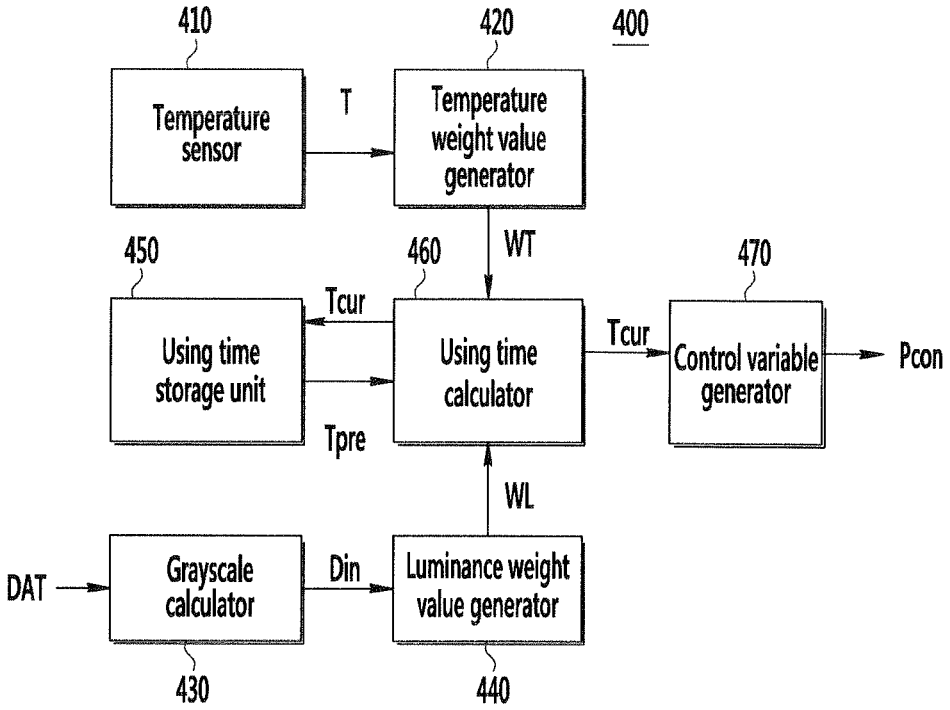
FIG. 2 shows a block diagram of a degradation compensator according to an exemplary embodiment of the present invention.
Figure 3:
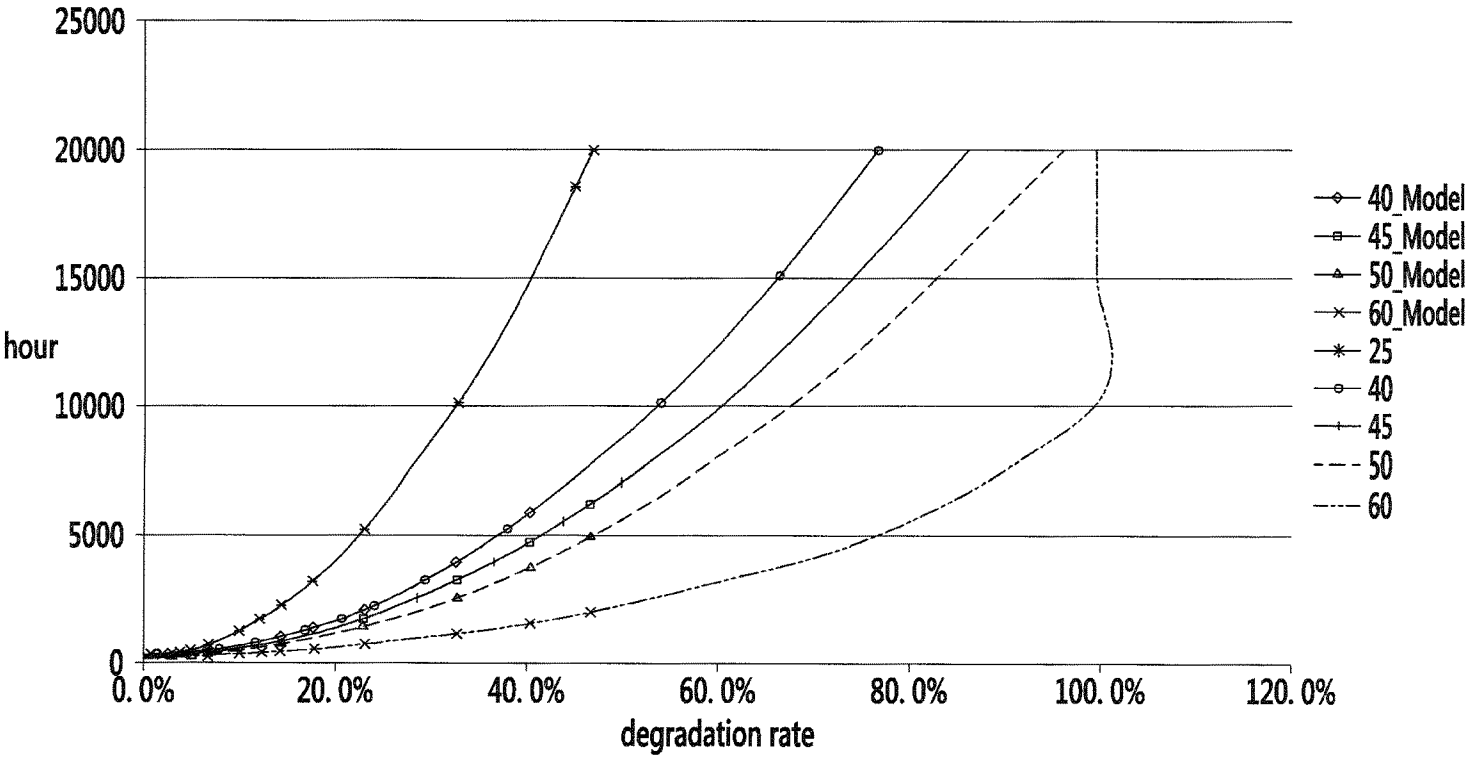
FIG. 3 shows a graph of a degradation curve of a pixel with respect to temperature according to an exemplary embodiment of the present invention.
Figure 4:
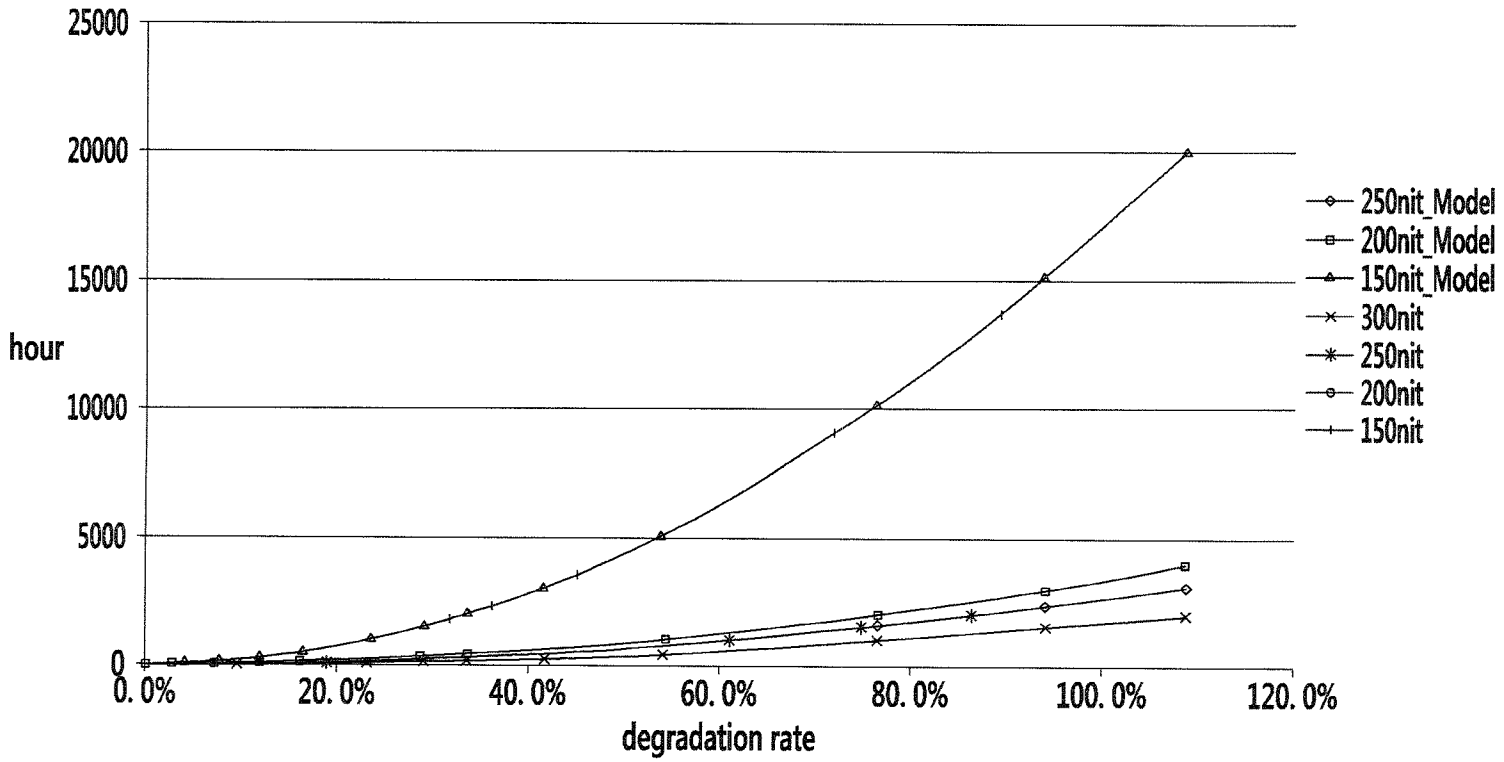
FIG. 4 shows a graph of a degradation curve of a pixel with respect to luminance according to an exemplary embodiment of the present invention.
Figure 5:
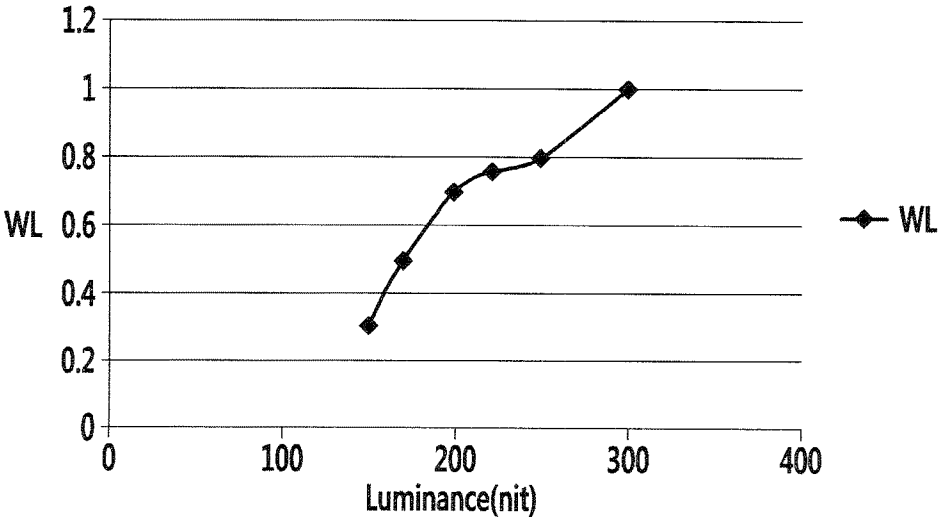
FIG. 5 shows a graph of a luminance weight value curve according to an exemplary embodiment of the present invention.
Figure 6:
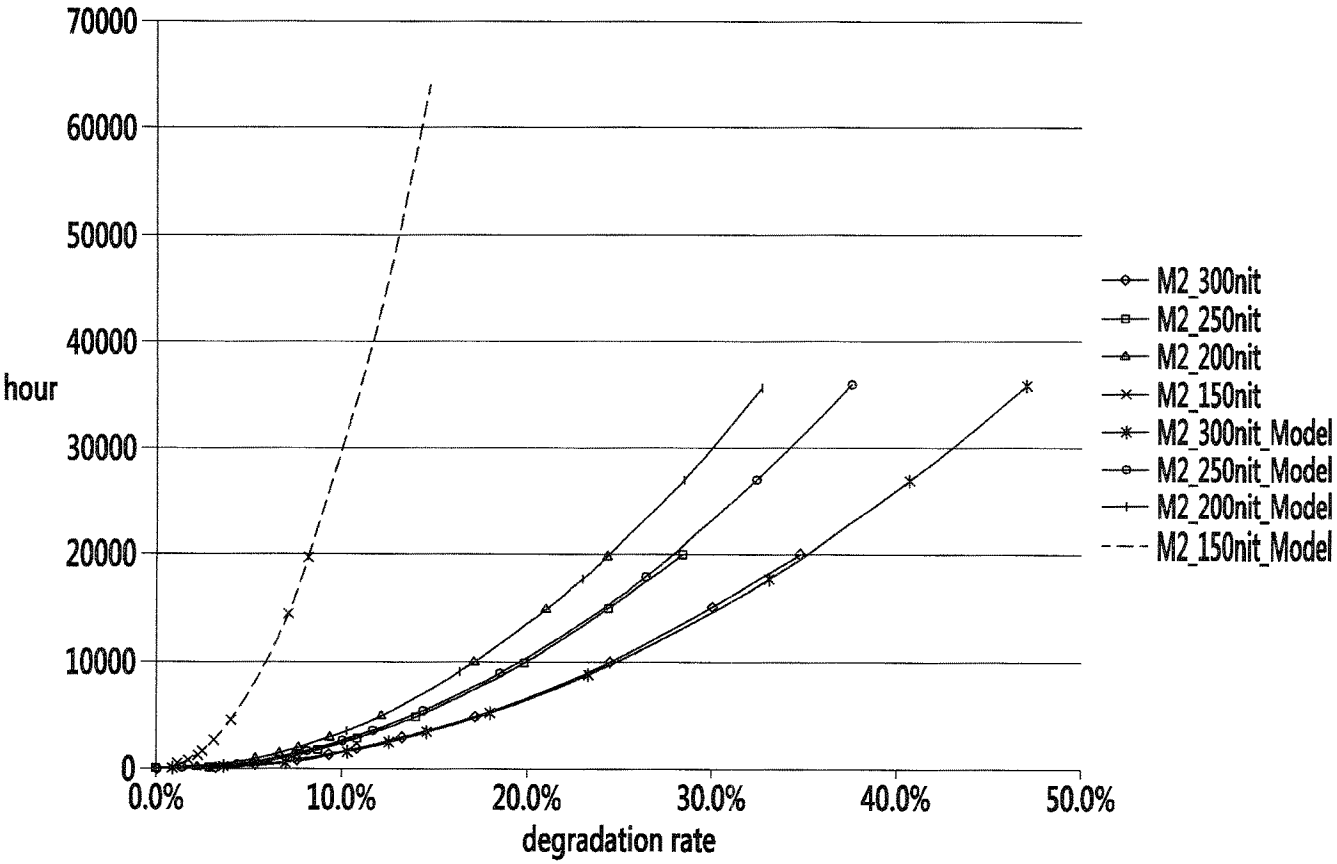
FIG. 6 shows a graph of a degradation curve of a pixel for a degradation rate of a pixel depending on a material according to an exemplary embodiment of the present invention.
Figure 7:
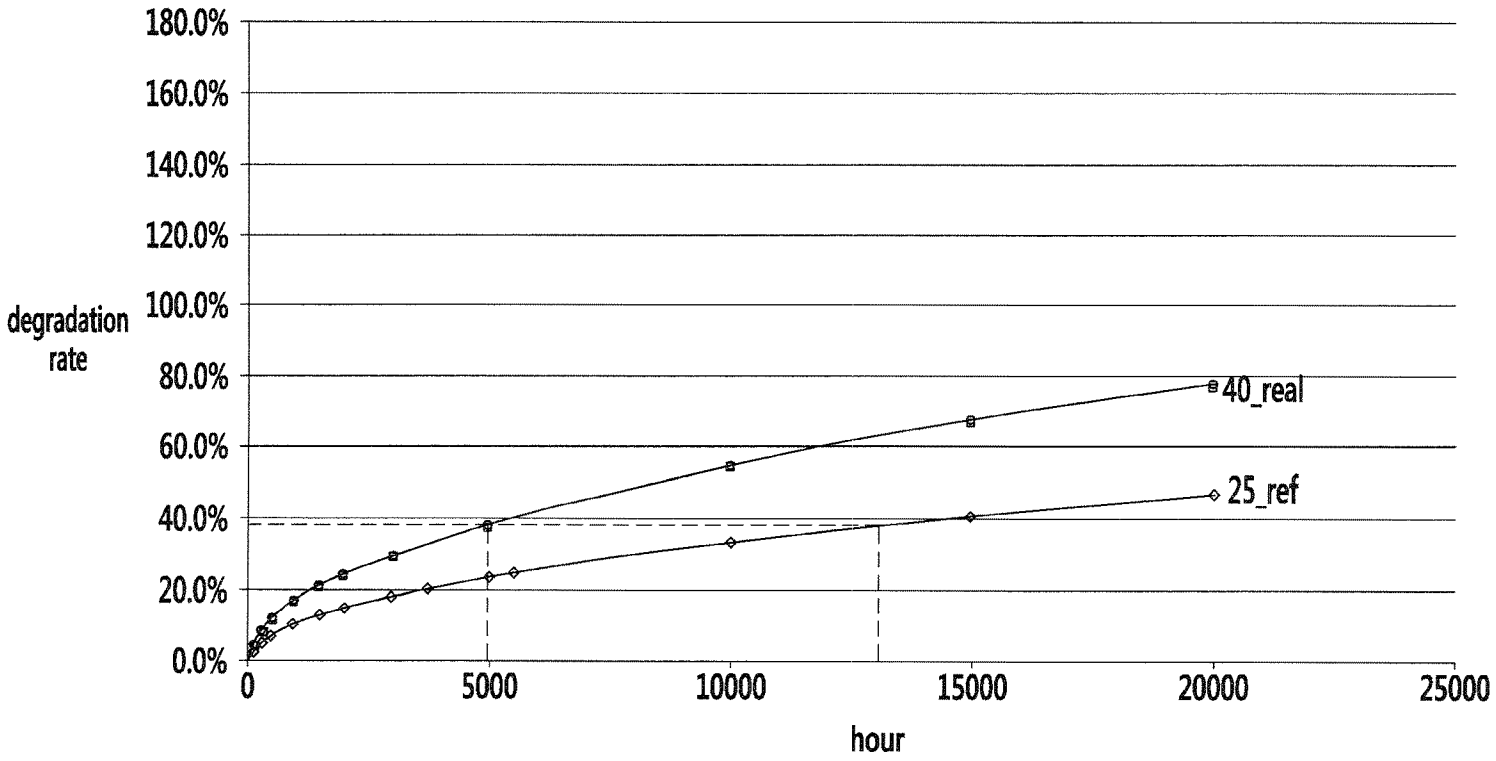
FIG. 7 shows a graph for comparing a reference degradation rate of a pixel and an actual degradation rate of a pixel calculated by a degradation compensator according to an exemplary embodiment of the present invention.

FIG. 2 shows a block diagram of a degradation compensator, FIG. 3 shows a graph of a degradation curve of a pixel with respect to temperature according to an exemplary embodiment of the present invention, FIG. 4 shows a graph of a degradation curve of a pixel with respect to luminance according to an exemplary embodiment of the present invention, FIG. 5 shows a graph of a luminance weight value curve according to an exemplary embodiment of the present invention, FIG. 6 shows a graph of a degradation curve of a pixel for a degradation rate of a pixel depending on a material according to an exemplary embodiment of the present invention, and FIG. 7 shows a graph for comparing a reference degradation rate of a pixel and an actual degradation rate of a pixel calculated by a degradation compensator according to an exemplary embodiment of the present invention.

Referring to FIGS. 2 to 7, the degradation compensator 400 includes a temperature sensor 410, a temperature weight value generator 420, a grayscale calculator 430, a luminance weight value generator 440, a using time storage unit 450, a using time calculator 460, and a control variable generator 470.

The temperature sensor 410 measures a temperature of a plurality of pixels (PX) and transmits the measured temperatures (T) to the temperature weight value generator 420.

The temperature weight value generator 420 generates a temperature weight value (WT) according to the temperature (T) transmitted by the temperature sensor 410. The temperature weight value (WT) shows a degradation rate according to the measured temperature (T) on the plurality of pixels (PX) with a ratio on the degradation rate at the reference temperature.

The degradation rate of the pixel has a tendency to be increased when the temperature is increased. The degradation rate of the pixel signifies the luminance reduction rate of a pixel. The degradation of the pixel according to an increase in temperature can be expressed by the product of a degradation function (a curve) of a pixel at the reference temperature and the temperature weight value (WT). The temperature weight value (WT) can be experimentally acquired by measuring the degradation rate of the pixel with respect to temperature. In the experiment for measuring the degradation rate of the pixel with respect to temperature, factors (e.g., luminance of an image and a material for configuring the pixel) that may influence the degradation rate of the pixel in addition to the temperature are set in a like manner.

In the degradation curve of the pixel with respect to temperature in FIG. 3, a degradation curve 25 at the reference temperature of 25°, a degradation curve 40 at 40°, a degradation curve 45 at 45°, a degradation curve 50 at 50°, and a degradation curve at 60° are shown based on values that are measured from a test. A degradation curve (40_Model) at 40° that is modeled by multiplying the degradation curve 25 at the reference temperature of 25° by the temperature weight value (WT), a degradation curve (45_Model) at 45°, a degradation curve (50_Model) at 50°, and a degradation curve (60_Model) at 60° are shown.

It is found that the modeled degradation curve (40_Model) at 40° corresponds to the degradation curve 40 at 40° that is measured through a test, the modeled degradation curve (45_Model) at 45° corresponds to the degradation curve 45 at 45° that is measured through a test, the modeled degradation curve (50_Model) at 50° corresponds to the degradation curve 50 at 50° that is measured through a test, the modeled degradation curve (60_Model) at 60° corresponds to the degradation curve 60 at 60° that is measured through a test.

That is, the degradation curve at the measured temperature (T) can be calculated by multiplying the degradation curve 25 at the reference temperature of 25° by the temperature weight value (WT) determined by the temperature. For example, when the degradation curve 25 at the reference temperature of 25° is multiplied by the temperature weight value (WT) of 2.63, the modeled degradation curve (40_Model) at 40° is calculated.

When storing the temperature weight value (WT) depending on the measured temperature (T), the temperature weight value generator 420 can output the temperature weight value (WT) corresponding to the measured temperature (T) transmitted by the temperature sensor 410, and can calculate a degradation curve at the measured temperature (T) according to the temperature weight value (WT). The temperature weight value generator 420 can store the temperature weight value (WT) corresponding to the measured temperature (T) into a look up table (LUT). The temperature weight value generator 420 can output the temperature weight value (WT) corresponding to the measured temperature of a plurality of pixels (PX) from the lookup table.

The grayscale calculator 430 receives an image data signal (DAT) and calculates an average grayscale (Din) of the image data signal (DAT). In this instance, the image data signal (DAT) includes grayscale information on the plurality of pixels (PX). That is, the grayscale calculator 430 averages the image data signal (DAT) including grayscale information on the plurality of pixels (PX) included in the display 600 to calculate an average grayscale (Din) on one image.

For example, it is set that an R pixel, a G pixel, a B pixel, and a G pixel from among a plurality of pixels (PX) included in the display 600 form a dot and resolution of the display 600 is Res. Here, the R pixel represents a pixel that emits red light, the G pixel represents a pixel that emits green light, the B pixel represents a pixel that emits blue light, and the resolution Res represents a total number of dots.

In this instance, an average grayscale (Din) of the image data signal (DAT) can be calculated as expressed in Equation 1.

$$Din = \left[\sum_{n=1}^{Res} \frac{Rn + Gn + Bn + Gn}{4}\right] \Big/ Res \qquad \text{(Equation 1)}$$

Here, Rn is a signal that is inputted to the R pixel, Gn is a signal that is inputted to the G pixel, and Bn is a signal that is inputted to the B pixel. The Rn, Gn, and Bn signals have a predetermined grayscale and are included in the image data signal (DAT).

Equation 1 for finding the average grayscale (Din) of the image data signal (DAT) is one example. A method for forming dots in a plurality of pixels (PX) included in the display 600, that is, the method for arranging the pixels (PX) can be determined in various manners, and hence, the method for calculating the average grayscale (Din) of the image can be determined.

The grayscale calculator 430 of FIG. 1 transmits the calculated average grayscale (Din) to the luminance weight value generator 440.

The luminance weight value generator 440 generates a luminance weight value (WL) following luminance of the image. The luminance weight value (WL) indicates a degradation rate of the image with respect to luminance as a ratio for the degradation rate at the reference luminance. The luminance weight value generator 440 uses the average grayscale (Din) of the image to calculate the luminance of the image, and uses the degradation rate of a pixel caused by the calculated luminance to generate a luminance weight value.

Table 1 expresses an exemplary relationship of the average grayscale (Din) versus luminance when it is assumed that the grayscale of the image has a grayscale value of 0 to 255 and the luminance follows the gamma of 2.2 with the average grayscale (Din).

TABLE 1

| Din | 186 | 212 | 234 | 255 |
|---|---|---|---|---|
| Luminance (nit) | 150 | 200 | 250 | 300 |

When the average grayscale (Din) of the image data signal (DAT) is 186, the pixels (PX) emit light with a luminance of 150nit by the image data signal (DAT). When the average grayscale (Din) of the image data signal (DAT) is 212, the pixels (PX) emit light with a luminance of 200nit by the image data signal (DAT). When the average grayscale (Din) of the image data signal (DAT) is 234, the pixels (PX) emit light with a luminance of 250nit by the image data signal (DAT). When the average grayscale (Din) of the image data signal (DAT) is 255, the pixels (PX) emit light with a luminance of 300nit by the image data signal (DAT). As described, the luminance of the image corresponding to the average grayscale (Din) of the image data signal (DAT) can be measured experimentally.

The luminance weight value generator 440 can store the luminance of the image corresponding to the average grayscale (Din) of the image data signal (DAT) in a lookup table (LUT). The luminance weight value generator 440 can extract the luminance of the image corresponding to the average grayscale (Din) of the image data signal (DAT) from the lookup table (LUT).

The luminance weight value generator 440 calculates the luminance of the image corresponding to the average grayscale (Din) of the image data signal (DAT), and uses the degradation rate of the pixel following the luminance to calculate the luminance weight value. The degradation rate of the pixel following the luminance can be measured through a test. In the test for measuring the degradation rate of the pixel following luminance, the conditions that may influence the degradation rate of the pixel, other than the luminance (e.g., temperature or a material for configuring the pixel), are set in an equivalent manner.

The degradation rate of the pixel tends to be increased when the luminance is increased. A trend for the pixel to be degraded according to luminance can be expressed with a product of a degradation function (a curve) of the pixel and a luminance weight value (WL) at the reference luminance.

In a degradation curve of the pixel with respect to luminance in FIG. 4, a degradation curve (300nit) at the reference luminance 300nit, a degradation curve (250nit) at 250nit, a degradation curve (200nit) at 200nit, and a degradation curve (150nit) at 150nit are shown based on the values that are measured through a test. A degradation curve (250nit_Model) at 250nit that is modeled by multiplying a degradation curve (300nit) at the reference luminance 300nit by the luminance weight value (WL), a degradation curve (200nit_Model) at 200nit, and a degradation curve (150nit_Model) at 150nit are shown.

It is found that the modeled degradation curve (250nit_Model) at 250nit matches the degradation curve (250nit) at 250nit that is measured through a test, the modeled degradation curve (200nit_Model) at 200nit matches the degradation curve (200nit) at 200nit that is measured through a test, and the modeled degradation curve (150nit_Model) at 150nit matches the degradation curve (150nit) at 150nit that is measured through a test.

That is, the degradation curve at a random luminance can be calculated by multiplying the degradation curve (300nit) at the reference luminance 300nit by the luminance weight value (WL) that is determined by luminance. The luminance weight value (WL) corresponding to the luminance of the image can be measured through a test, and the luminance weight value generator 440 can store the luminance weight value (WL) that corresponds to the luminance of the image in the lookup table (LUT). The luminance weight value generator 440 can extract the luminance weight value (WL) corresponding to the luminance of image from the lookup table (LUT).

Table 2 exemplarily shows luminance weight values (WL) corresponding to luminance of the image.

TABLE 2

| Din | 186 | 212 | 234 | 255 |
|---|---|---|---|---|
| Luminance (nit) | 150 | 200 | 250 | 300 |
| WL | 0.3 | 0.7 | 0.8 | 1 |

For example, the modeled degradation curve (250nit_Model) at 250nit is calculated by multiplying the degradation curve (300nit) at the reference luminance 300nit by the luminance weight value (WL) of 0.8.

A luminance weight value curve for showing the luminance weight value (WL) for the luminance of image can be shown as FIG. 5.

Therefore, the luminance weight value generator 440 can calculate the luminance weight value (WL) caused by the luminance of an image corresponding to the average grayscale (Din) of the image data signal (DAT). The luminance weight value generator 440 can store the luminance weight value (WL) corresponding to the average grayscale (Din) of the image data signal (DAT) in the lookup table (LUT).

The luminance weight value generator 440 transmits the generated luminance weight value (WL) to the using time calculator 460.

The using time calculator 460 calculates a reference using time (Tcur) by using a material weight value (WM), a using time weight value (WT), and a luminance weight value (WL).

The material weight value (WM) shows the degradation rate caused by a material included in a plurality of pixels (PX) as a ratio for the degradation rate of the pixel including a reference material. The material weight value (WM) is determined by the material of the pixel, and the using time calculator 460 stores the material weight value (WM) following the material of the pixel included in the display device. The using time calculator 460 receives the temperature weight value (WT) and the luminance weight value (WL) and outputs the stored material weight value (WM).

For example, when the display device is an organic light emitting diode (OLED) display, organic light emitting diodes (OLED) included in a plurality of pixels included in the organic light emitting diode (OLED) display are classified as a small molecular organic light emitting diode (OLED) and a polymer organic light emitting diode (OLED) depending on the amount of organic material. The degradation rate of the pixel depends on the amount or kind of organic material configuring the organic light emitting diode (OLED). That is, the degradation rate of the pixel is different according to the material of the pixel.

FIG. 6 shows a graph of a test for measuring a degradation rate of pixels with respect to luminance for the pixels that are formed with a material M2 that is different from the material of the pixels used for the test for measuring the degradation rate of pixels with respect to luminance of FIG. 4.

In the degradation rate curve of pixels with respect to luminance of FIG. 6, a degradation curve (M2_300nit) at 300nit, a degradation curve (M2_250nit) at 250nit, a degradation curve (M2_200nit) at 200nit, and a degradation curve (M2_150nit) at 150nit are shown based on the values that are measured through a test. A degradation curve (M2_300nit_Model) at 300nit that is modeled by multiplying the degradation curve (300nit) at 300nit of FIG. 4 by a material weight value (WM), a degradation curve (M2_250nit_Model) at 250nit that is modeled by multiplying the degradation curve (250nit) at 250nit of FIG. 4 by a material weight value (WM), a degradation curve (M2_200nit_Model) at 200nit that is modeled by multiplying the degradation curve (200nit) at 200nit of FIG. 4 by a material weight value (WM), and a degradation curve (M2_150nit_Model) at 150nit that is modeled by multiplying the degradation curve (150nit) at 150nit of FIG. 4 by a material weight value (WM) are shown.

It is found that the modeled degradation curve (M2_300nit_Model) at 300nit matches the degradation curve (M2_300nit) at 300nit that is measured through a test, the modeled degradation curve (M2_250nit_Model) at 250nit matches the degradation curve (M2_250nit) at 250nit that is measured through a test, the modeled degradation curve (M2_200nit_Model) at 200nit matches the degradation curve (M2_200nit) at 200nit that is measured through a test, and the modeled degradation curve (M2_150nit_Model) at 150nit matches the degradation curve (M2_150nit) at 150nit that is measured through a test.

That is, when the material of the pixel used for the degradation rate measuring test of the pixels with respect to luminance of FIG. 4 is set to be a reference material, the degradation curve of pixels depending on the material can be calculated by multiplying the degradation curve of the pixels including the reference material by the material weight value (WM) that is determined by the material.

For example, the reference material of the organic light emitting diode (OLED) represents a material that is manufactured by setting the amount of the organic material according to a specific reference. The material weight value (WM) for the reference material can be measured through a degradation test for the pixels to which a material with a different amount of an organic material corresponding to the reference material is used.

The using time calculator 460 calculates the reference using time (Tcur) by using the sum of the an accumulated using time (Tpre) and a value that is generated by multiplying an added using time (Tadd) that is added after the accumulated using time (Tpre) by the temperature weight value (WT), the luminance weight value (WL), and the material weight value (WM).

Equation 2 shows an exemplary method for calculating the reference using time (Tcur).

$$Tcur=Tpre+WT\times WL\times WM\times Tadd \quad \text{(Equation 2)}$$

The reference using time (Tcur) represents a using time when the actual degradation rate of the pixel, under the conditions of the actual temperature of the display device, luminance and a material, is exchanged with the reference degradation rate of the pixel, under the conditions of the reference temperature (e.g., 25° C.), the reference luminance (e.g., 300nit) and the reference material (e.g., the material of the pixels used for the test of FIG. 4). The reference degradation rate of the pixel represents the degradation rate of the reference degradation curve of the pixel under the conditions of the reference temperature (e.g., 25° C.), the reference luminance (e.g., 300nit) and the reference material (e.g., the material of the pixel used for the test of FIG. 4).

That is, the using time calculator 460 uses the temperature weight value (WT), the luminance weight value (WL), and the material weight value (WM) to calculate the reference using time (Tcur) when the actual degradation rate of the pixel, under the conditions of the actual temperature of the display device, luminance and material, is expressed as the reference degradation rate of the pixel, under the conditions of the reference temperature, the reference luminance and the reference material.

The reference degradation rate of the pixel according to the reference using time (Tcur) is calculated in a manner similar to calculation of the actual degradation rate of the pixel.

The graph for comparing the calculated reference degradation rate of the pixel of FIG. 7 and the actual degradation rate of the pixel shows the degradation curve (40_Real) for indicating the actual degradation rate of the pixel according to the actual using time under the conditions of the temperature 40°, the luminance of 300nit, and the material of the pixel used for the test of FIG. 4. The graph also shows the reference degradation curve (25_ref) for indicating the reference degradation rate of the pixel according to the reference using time (Tcur) under the conditions of the reference temperature 25°, the reference luminance (300nit), and the reference material (the material of the pixel used for the test of FIG. 4).

For example, when the pixel is actually driven for 5000 hours, the actual degradation rate of the pixel according to the actual using time of 5000 hours in the actual degradation curve (40_Real) is substantially 38%. In Equation 2 for calculating the reference using time (Tcur), the accumulated using time (Tpre) becomes 0, the temperature weight value (WT) at the temperature 40° for the reference temperature 25° becomes 2.63, and the luminance weight value (WL) and the material weight value (WM) become 1. Accordingly, the reference using time (Tcur) becomes $Tcur=0+2.63\times1\times1\times5000=13{,}150$. In the reference degradation curve (25_ref), the reference degradation rate of the pixel for the reference using time of 13,150 hours substantially becomes 38%.

Therefore, the reference degradation rate of the pixel according to the reference using time (Tcur) is calculated in a manner similar to calculation of the actual degradation rate of the pixel.

The using time calculator 460 transmits the calculated reference using time (Tcur) to the using time storage unit 450, and the using time storage unit 450 updates the reference using time (Tcur) with the recently calculated accumulated using time (Tpre). When the using time calculator 460 calculates the next reference using time (Tcur), the using time storage unit 450 transmits the stored accumulated using time (Tpre) to the using time calculator 460.

The using time calculator 460 periodically calculates the reference using time (Tcur) or calculates the reference using time (Tcur) when an accident occurs. The using time storage unit 450 transmits the stored accumulated using time (Tpre) to the using time calculator 460 each time the using time calculator 460 calculates the reference using time (Tcur). The using time calculator 460 transmits the calculated reference using time (Tcur) to the using time storage unit 450 each time the reference using time (Tcur) is calculated.

The using time calculator 460 transmits the calculated reference using time (Tcur) to the control variable generator 470.

The control variable generator 470 generates a control variable (Pcon) according to the reference using time (Tcur). A value of the control variable (Pcon) can be established with reference to a luminance reduction rate following the reference using time (Tcur), that is, the degradation rate of the pixel.

Table 3 expresses exemplary luminance reduction rates following the reference using time (Tcur), and corresponding control variables (Pcon).

TABLE 3

| | Tcur (hours) | | | | | | |
|---|---|---|---|---|---|---|---|
| | 240 | 1000 | 3000 | 10000 | 15000 | 20000 | Greater than 20,000 |
| Luminance reduction rate | 5.2% | 10.2% | 18% | 33% | 41% | 47.1% | Greater than 47.1% |
| Pcon | 0 | 1 | 1 | 2 | 3 | 4 | 5 |

When the reference using time (Tcur) is 0 to 240 hours, the control variable (Pcon) is output to be 0; when the reference using time (Tcur) is 240 to 3000 hours, the control variable (Pcon) is output to be 1; when the reference using time (Tcur) is 3000 to 10,000 hours, the control variable (Pcon) is output to be 2; when the reference using time (Tcur) is 10,000 to 15,000 hours, the control variable (Pcon) is output to be 3; when the reference using time (Tcur) is 15,000 to 20,000 hours, the control variable (Pcon) is output to be 4; and when the reference using time (Tcur) is greater than 20,000 hours, the control variable (Pcon) is output to be 5.

In Table 3, the range of a reference using time (Tcur) or a luminance reduction rate for determining the control variable (Pcon) may be variously determined.

Referring to FIG. 1, the power supply 500 controls a voltage difference between the first power source voltage (ELVDD) and the second power source voltage (ELVSS) according to the control variable (Pcon). The power supply 500 changes a voltage level of the second power source voltage (ELVSS) according to the control variable (Pcon) so as to control a voltage difference between the first power source voltage (ELVDD) and the second power source voltage (ELVSS).

Equation 3 expresses a method for controlling the voltage difference between the first power source voltage (ELVDD) and the second power source voltage (ELVSS) by reducing the voltage level of the second power source voltage (ELVSS). In this instance, the voltage level of the first power source voltage (ELVDD) is maintained.

$$ELVSS'=ELVSS-Pcon\times 0.1\text{ V} \quad \text{(Equation 3)}$$

Here, the ELVSS is a second power source voltage before a voltage level is controlled, and ELVSS' is the second power source voltage after the voltage level is controlled.

As described, the power supply 500 reduces the voltage level of the second power source voltage (ELVSS) by each 0.1 V according to the control variable (Pcon) so as to increase the voltage difference between the first power source voltage (ELVDD) and the second power source voltage (ELVSS).

In addition, the power supply 500 can change the voltage level of the first power source voltage (ELVDD) according to the control variable (Pcon) so as to control the voltage difference between the first power source voltage (ELVDD) and the second power source voltage (ELVSS).

Equation 4 expresses a method for controlling a voltage difference between the first power source voltage (ELVDD) and the second power source voltage (ELVSS) by increasing the voltage level of the first power source voltage (ELVDD). In this instance, the voltage level of the second power source voltage (ELVSS) is maintained.

$$ELVDD'=ELVDD+Pcon\times 0.1\text{ V} \quad \text{(Equation 4)}$$

Here, the ELVDD is a first power source voltage before the voltage level is controlled, and the ELVDD' is the first power source voltage after the voltage level is controlled.

Therefore, the power supply 500 increase the voltage level of the first power source voltage (ELVDD) by each 0.1 V according to the control variable (Pcon) so as to increase the voltage difference between the first power source voltage (ELVDD) and the second power source voltage (ELVSS).

When the voltage difference between the first power source voltage (ELVDD) and the second power source voltage (ELVSS) is increased, reduction of the current flowing to the pixel caused by degradation of pixels is compensated, and deterioration of luminance caused by degradation of pixels is compensated.

As suggested, the method for compensating the luminance deterioration caused by degradation of pixels by controlling the voltage difference between the first power source voltage (ELVDD) and the second power source voltage (ELVSS) according to the control variable (Pcon) can reduce power consumption of the display device compared to the conventional method of setting the voltage difference between the first power source voltage (ELVDD) and the second power source voltage (ELVSS) to be great at the time of product delivery in consideration of degradation of pixels.

For example, it will be assumed that a display device with the first power source voltage (ELVDD) of 5.0 V, the second power source voltage (ELVSS) of −1.7 V, and the pixel driving current of 300 mA is driven for 5000 hours. In this instance, the pixel of the display device is assumed to be configured with the reference material and is driven under the conditions of the reference temperature and the reference luminance. As suggested, when the control variable (Pcon) is outputted as expressed in Table 3 and the voltage difference between the first power source voltage (ELVDD) and the second power source voltage (ELVSS) is controlled according to Equations 3 or 4, power amount (Pc) of the display device becomes 10252.8 Wh. In a like manner of prior art, when the voltage of the second power source voltage (ELVSS) is set to be reduced by 0.5 V, the power amount (Pp) of the display device becomes 10,800 Wh. In comparison of power amounts, it is given that Pc/Pp=0.949. That is, the proposed display device can substantially reduce 5.1% of power consumption compared to the conventional display device.

Furthermore, calculation, a time weight value caused by a using time can be used when the reference using time (Tcur) is calculated.

Referring to FIG. 2, the using time calculator 460 can calculate the reference using time (Tcur) according to Equation 5.

Equation 5 shows another exemplary method for calculating the reference using time (Tcur).

$$Tcur=Tpre+WT\times WL\times WM\times WP\times Tadd \quad \text{(Equation 5)}$$

Compared to Equation 2, Equation 5 shows that the additional using time (Tadd) is multiplied by the time weight value (WP). The time weight value (WP) is established by the accumulated using time (Tpre) transmitted by the using time storage unit 450. The trend for the pixel to be degraded according to the accumulated using time (Tpre) is shown to be non-linear when measured experimentally.

Table 4 shows that a degradation curve of the pixel is found with respect to the accumulated using time (Tpre), and a slope between respective accumulated using times (Tpre) is found by assuming that the degradation curve between the accumulated using times (Tpre) is a straight line. The slope between the accumulated using times (Tpre) represents the time weight value (WP) according to the accumulated using time (Tpre).

TABLE 4

| Tpre (hour) | WP |
|---|---|
| 24 | 0.373 |
| 72 | 0.680 |
| 120 | 0.432 |
| 240 | 0.273 |
| 500 | 0.204 |
| 1000 | 0.252 |
| 1500 | 0.292 |
| 2000 | 0.180 |
| 3000 | 0.117 |
| 5000 | 0.066 |
| 10000 | 0.081 |
| 15000 | 0.094 |

The time weight value (WT), the luminance weight value (WL), and the material weight value (WM) correspond to the above description and so they will not be described in further detail.

The compensation for changing the grayscale of the image data signal (DAT) transmitted to the data driver 300 can be performed as well as the compensation for controlling the voltage difference between the first power source voltage (ELVDD) and the second power source voltage (ELVSS) according to the control variable (Pcon).

For example, when the display device is driven for 1500 hours under the conditions of the reference temperature of 25°, the reference luminance (300nit) and the reference material, luminance reduction rate of the pixel is 41% and the control variable (Pcon) is outputted to be 3 so that the voltage difference between the first power source voltage (ELVDD) and the second power source voltage (ELVSS) is increased by 0.3 V and is then controlled. In this instance, the luminance reduction of pixels can be compensated when the grayscale is increased by 60% so as to compensate the luminance reduction rate of 41% of the pixel. When the grayscale of a random image data signal (DAT) is assumed to be 128, the grayscale of the image data signal (DAT) becomes $128\times1.6\times0.59\times1.06=128.08$ by the compensation for increasing the grayscale. In the latter regard, 1.6 is the value for increasing the grayscale, 0.59 is the value to which the luminance reduction rate of 41% is applied, and 1.06 is the value to which a change of luminance is applied by controlling the voltage difference between the first power source voltage (ELVDD) and the second power source voltage (ELVSS). Accordingly, luminance reduction caused by degradation of pixels can be compensated by increasing the grayscale of the image data signal (DAT) in consideration of the luminance reduction rate of pixels.

The foregoing referenced drawings and detailed description of the present invention are all exemplary, and are used for explaining the present invention, but they do not limit the meaning or the scope of the present invention defined in the claims. Therefore, those skilled in the art will understand the present disclosure to cover various modifications and equivalent embodiments. Accordingly, the true technical scope of the present should be defined by the technical spirit of the appended claims.

What is claimed is:

1. A display device, comprising:

a plurality of pixels;

a degradation compensator for using a temperature weight value for a reference temperature, a luminance weight value for a reference luminance, and a material weight value for a reference material, for calculating a reference using time when a degradation rate of the pixels is exchanged with a reference degradation rate of a reference degradation curve, and for generating a control variable according to the reference using time, said material weight value is a degradation rate for the reference material; and a power supply for controlling a voltage difference between a first power source voltage for supplying a driving current to the pixels and a second power source voltage according to the control variable.

2. The display device of claim 1, the temperature weight value representing a ratio of a degradation rate caused by a measured temperature of the pixels to a degradation rate at the reference temperature.

3. The display device of claim 2, the degradation compensator storing the temperature weight value corresponding to the measured temperature of the pixels in a look up table (LUT).

4. The display device of claim 1, the degradation compensator calculating an average grayscale of an image data signal including grayscale information on the pixels, and calculating luminance of an image corresponding to the average grayscale of the image data signal.

5. The display device of claim 4, the luminance weight value being a ratio of a degradation rate caused by luminance of the image to the degradation rate for the reference luminance.

6. The display device of claim 4, the degradation compensator storing the luminance weight value corresponding to the average grayscale of the image data signal in a lookup table (LUT).

7. The display device of claim 4, the degradation compensator storing the luminance weight value corresponding to luminance of the image in a lookup table (LUT).

8. The display device of claim 1, the material weight value being a ratio of a degradation rate caused by a material included in the pixels to a degradation rate of a pixel including the reference material.

9. The display device of claim 1, the degradation compensator calculating the reference using time by using a sum of an accumulated using time and a value that is generated by multiplying an additional using time that is added after the accumulated using time of the pixels by the temperature weight value, the luminance weight value and the material weight value.

10. The display device of claim 9, the degradation compensator updating the calculated reference using time as an accumulated using time of the pixels and storing the same.

11. The display device of claim 1, the degradation compensator calculating the reference using time by using a sum of the accumulated using time and a value that is generated by multiplying the additional using time that is added after the accumulated using time of the pixels by the temperature weight value, the luminance weight value, the material weight value and the time weight value according to the accumulated using time.

12. The display device of claim 1, the power supply reducing the second power source voltage so as to increase the voltage difference between the first power source voltage and the second power source voltage when the control variable is increased.

13. The display device of claim 1, the power supply increasing the first power source voltage so as to increase the voltage difference between the first power source voltage and the second power source voltage when the control variable is increased.

14. A degradation compensating device, comprising:

a temperature weight value generator for generating a temperature weight value for indicating a degradation rate caused by a measured temperature of a plurality of pixels transmitted by a temperature sensor as a value of the degradation rate with respect to a reference temperature;

a grayscale calculator for calculating an average grayscale of an image data signal including grayscale information on the pixels;

a luminance weight value generator for calculating luminance of an image corresponding to an average grayscale of the image data signal, and for generating a luminance weight value for indicating a degradation rate caused by luminance of the image as a value of the degradation rate at a reference luminance;

a using time calculator for storing a material weight value for indicating a degradation rate caused by a material included in the pixels as a value of a degradation rate of the pixel including a reference material, and for using the temperature weight value, the luminance weight value and the material weight value to calculate a reference using time when an actual degradation rate of the pixels is changed into a degradation rate on a reference degradation curve, said material weight is a degratdation rate for the reference material; and a control variable generator for generating a control variable according to the reference using time.

15. The degradation compensating device of claim 14, the temperature weight value generator storing the temperature weight value corresponding to a measured temperature of the pixels in a lookup table (LUT).

16. The degradation compensating device of claim 14, the luminance weight value generator storing the luminance weight value corresponding to an average grayscale of the image data signal in a lookup table (LUT).

17. The degradation compensating device of claim 14, the luminance weight value generator storing the luminance weight value corresponding to luminance of the image in a lookup table (LUT).

18. The degradation compensating device of claim 14, the using time calculator calculating the reference using time by using a sum of an accumulated using time and a value that is generated by multiplying an additional using time that is added after the accumulated using time of the pixels by the temperature weight value, the luminance weight value and the material weight value.

19. The degradation compensating device of claim 18, further comprising a using time storage unit for updating the calculated reference using time as an accumulated using time of the pixels, and for storing the same.

20. The degradation compensating device of claim 14, the using time calculator calculating the reference using time by using a sum of an accumulated using time and a value that is generated by multiplying an additional using time that is added after the accumulated using time of the pixels by the temperature weight value, the luminance weight value, the material weight value and the time weight value following the accumulated using time.

21. The degradation compensating device of claim 14, further comprising a power supply for controlling a voltage difference between a first power source voltage for supplying a driving current to the pixels according to the control variable and a second power source voltage.

22. The degradation compensating device of claim 21, the power supply reducing the second power source voltage so as to increase a voltage difference between the first power source voltage and the second power source voltage when the control variable is increased.

23. The degradation compensating device of claim 21, the power supply increasing the first power source voltage so as to increase a voltage difference between the first power source voltage and the second power source voltage when the control variable is increased.

24. A degradation compensating method, comprising the steps of:

generating a temperature weight value for indicating a degradation rate caused by a measured temperature of a plurality of pixels transmitted by a temperature sensor with a value of a degradation rate at a reference temperature;

calculating an average grayscale of an image data signal including grayscale information on the pixels;

calculating a luminance of an image corresponding to the average grayscale of the image data signal, and generating a luminance weight value for indicating the degradation rate caused by the luminance of image as a value of a degradation rate at a reference luminance;

outputting a material weight value for indicating a degradation rate caused by a material included in the pixels as a value of the degradation rate of the pixel including a reference material, said material weight value is a degradation rate for the reference material;

calculating a reference using time when an actual degradation rate of the pixels is exchanged with a degradation rate on a reference degradation curve by using the temperature weight value, the luminance weight value and the material weight value; and generating a control variable according to the reference using time.

25. The degradation compensating method of claim 24, further comprising the step of controlling a voltage difference between a first power source voltage for supplying a driving current to the pixels and a second power source voltage according to the control variable.

26. The degradation compensating method of claim 25, the controlling of a voltage difference between a first power source voltage and a second power source voltage including reducing the second power source voltage so as to increase the voltage difference between the first power source voltage and the second power source voltage when the control variable is increased.

27. The degradation compensating method of claim 25, the controlling of a voltage difference between a first power source voltage and a second power source voltage including increasing the first power source voltage so as to increase the voltage difference between the first power source voltage and the second power source voltage when the control variable is increased.

28. The degradation compensating method of claim 24, the generating of a temperature weight value including outputting the temperature weight value corresponding to a measured temperature of the pixels from a lookup table (LUT).

29. The degradation compensating method of claim 24, the generating of a luminance weight value including outputting the luminance weight value corresponding to an average grayscale of the image data signal from a lookup table (LUT).

30. The degradation compensating method of claim 24, the generating of a luminance weight value including outputting the luminance weight value corresponding to luminance of the image from a lookup table (LUT).

31. The degradation compensating method of claim 24, the calculating of a reference using time including calculating the reference using time by using a sum of an accumulated using time and a value that is generated by multiplying an additional using time that is added after the accumulated using time of the pixels by the temperature weight value, the luminance weight value and the material weight value.

32. The degradation compensating method of claim 31, further comprising the step of updating the calculated reference using time as an accumulated using time of the pixels, and storing the updated calculated reference.

* * * * *